US010350482B2

(12) United States Patent
LaDuca

(10) Patent No.: US 10,350,482 B2
(45) Date of Patent: Jul. 16, 2019

(54) CASINO CRAPS WITH OPTIONAL ALL DICE ROLL COMBINATIONS SIDE BET

(71) Applicant: AGS LLC, Las Vegas, NV (US)

(72) Inventor: Ronald LaDuca, Cherry Hill, NJ (US)

(73) Assignee: AGS LLC, Las Vegas, NV (US)

( * ) Notice: Subject to any disclaimer, the term of this patent is extended or adjusted under 35 U.S.C. 154(b) by 73 days.

(21) Appl. No.: 15/494,743

(22) Filed: Apr. 24, 2017

(65) Prior Publication Data

US 2017/0225064 A1 Aug. 10, 2017

Related U.S. Application Data

(63) Continuation of application No. 14/326,433, filed on Jul. 8, 2014, now abandoned.

(60) Provisional application No. 61/959,973, filed on Sep. 6, 2013.

(51) Int. Cl.

| | |
|---|---|
| ***A63F 3/08*** | (2006.01) |
| ***A63F 3/00*** | (2006.01) |
| ***G07F 17/32*** | (2006.01) |
| ***A63F 9/04*** | (2006.01) |

(52) U.S. Cl.

CPC ..... *A63F 3/00157* (2013.01); *A63F 9/04* (2013.01); *G07F 17/326* (2013.01); *G07F 17/3213* (2013.01); *G07F 17/3244* (2013.01)

(58) Field of Classification Search

CPC ..... A63F 9/04; G07F 17/3244; G07F 17/326; G07F 17/3213; G07F 17/3262

See application file for complete search history.

(56) References Cited

U.S. PATENT DOCUMENTS

| | | | |
|---|---|---|---|
| 5,487,547 | A | 1/1996 | Hobert |
| 5,490,670 | A | 2/1996 | Hobert |
| 5,513,851 | A | 5/1996 | Harris |
| 5,728,002 | A | 3/1998 | Hobert |
| 5,829,749 | A | 11/1998 | Hobert |
| 5,934,676 | A | 8/1999 | Rubin |
| 6,655,689 | B1 | 12/2003 | Stasi |
| 6,761,353 | B2 | 7/2004 | Berman et al. |
| 6,805,352 | B2 | 10/2004 | Hunter |
| 7,100,919 | B2 | 9/2006 | Stasi |
| 7,377,513 | B2 | 5/2008 | Friedman |
| 7,661,677 | B2 | 2/2010 | Friedman |

(Continued)

OTHER PUBLICATIONS

"Craps Side Bets", archive Aug. 15, 2012, wizardofodds.com, <https://web.archive.org/web/20120815220739/https://wizardofodds.com/games/craps/appendix/5/>.*

*Primary Examiner* — Justin L Myhr
(74) *Attorney, Agent, or Firm* — Weide & Miller, Ltd.

(57) ABSTRACT

An additional optional, side bet area is included on the standard casino craps table for additional betting during the regular play of craps. Players bet that every dice roll combination of 2 or more designated point numbers, 4, 5, 6, 8, 9, or 10, will be rolled on the dice before a 7 is rolled. Bets are placed in accordance with casino regulations before the come out roll. During the come out roll if a 7 rolls, all side bets are lost; if a 2, 3, 11, or 12, the bet is a push and can be removed or changed; if a 4, 5, 6, 8, 9, or 10, the bet stays until a 7 is rolled to end the round and cannot be removed or changed. If every dice roll combination of 2 or more of the designated point numbers has been rolled when the round ends, bets are paid according to a side bet payout table. If they are not rolled, the bet loses.

21 Claims, 5 Drawing Sheets

(56) References Cited

U.S. PATENT DOCUMENTS

| | | | | |
|---|---|---|---|---|
| 7,686,305 | B2 | 3/2010 | Stasi | |
| 8,118,309 | B1 | 2/2012 | Friedman | |
| 8,540,248 | B2 | 9/2013 | Golden | |
| 2004/0173966 | A1 | 9/2004 | Stasi | |
| 2006/0043678 | A1 | 3/2006 | Golden | |
| 2006/0097452 | A1 | 5/2006 | Ryan et al. | |
| 2006/0205458 | A1* | 9/2006 | Huber | G07F 17/3218 463/1 |
| 2006/0290050 | A1 | 12/2006 | Friedman | |
| 2008/0054565 | A1 | 3/2008 | O'Connor et al. | |
| 2008/0061505 | A1 | 3/2008 | Snow | |
| 2008/0122176 | A1 | 5/2008 | Dickerson et al. | |
| 2008/0128990 | A1 | 6/2008 | Lowery et al. | |
| 2009/0124348 | A1* | 5/2009 | Yoseloff | G07F 17/32 463/22 |
| 2010/0120536 | A1* | 5/2010 | Chatellier | G07F 17/3209 463/40 |
| 2012/0034970 | A1* | 2/2012 | Stephens | A63F 3/00157 463/22 |
| 2012/0135791 | A1* | 5/2012 | Chen | A63F 3/00157 463/12 |
| 2013/0225254 | A1 | 8/2013 | Pececnik | |

* cited by examiner

29

| | Table 1 | Table 2 | Table 3 |
|---|---|---|---|
| Any 2 number all dice roll combinations | 4-1 | 5-1 | 5-1 |
| Any 3 number all dice roll combinations | 10-1 | 10-1 | 10-1 |
| Any 4 number all dice roll combinations | 20-1 | 20-1 | 20-1 |
| Any 5 number all dice roll combinations | 50-1 | 50-1 | 50-1 |
| All 6 number all dice roll combinations | 200-1 | 200-1 | 300-1 |

CASINO CRAPS WITH OPTIONAL ALL DICE ROLL COMBINATIONS SIDE BET

RELATED APPLICATION DATA

This application is a continuation of U.S. patent application Ser. No. 14/326,433, filed Jul. 8, 2014, which claims the benefit of U.S. Provisional Application Ser. No. 61/959,973, filed Sep. 6, 2013. The present application claims priority to each of said applications and incorporates by reference each of said applications as if set forth fully herein.

FIELD OF THE INVENTION

The present invention relates to a method for playing a casino craps game with an optional side bet, and in particular to a method for playing a casino craps game with an optional side bet for a shooter rolling all of the dice roll combinations for point numbers requiring all of the dice roll combinations of at least two point numbers and more up to all six point numbers having all of the dice roll combinations for the point numbers rolled in any order before a shooter rolls a 7, thereby providing much higher payout odds than other casino craps bet, up to 200 to 1 or 300 to 1 payout odds for the optional side bet which may remain on the table through a number of rounds and a number of shooters until a shooter rolls a 7.

BACKGROUND OF THE INVENTION

Gamblers enjoy side betting in casino games to increase the opportunity of winning and just to have another opportunity to gamble. But there is also a need to preserve the integrity of the game being played to maintain the original unadulterated use of dice and play so that the original casino craps game is not altered by the side betting game.

There were previously no casino craps bets or casino craps side bets for a shooter rolling all of the dice roll combinations for point numbers requiring all of the dice roll combinations of at least two point numbers and more up to all six point numbers having all of the dice roll combinations for the point numbers rolled in any order before a shooter rolls a 7.

There were previously no casino craps bets or casino craps side bets providing much higher payout odds than other casino craps bets. None of the prior regular play casino craps bets provide up to 200 to 1 or 300 to 1 payout odds.

There were no prior casino crap bets or casino craps side bets which provide an optional side bet which my remain on the table through a number of rounds and a number of shooters until a shooter rolls a 7.

U.S. Pat. No. 8,118,309, issued Feb. 21, 2012 and U.S. Pat. No. 7,661,677 issued Feb. 16, 2010 both to Friedman, are for a wager for casino craps which allows a player to win when a come out shooter makes a hard point (e.g. rolls 2/2 or 3/3 or 4/4 or 5/5), and then the shooter makes the point (before the shooter rolls a seven) with the same hard point (e.g. 2/2 or 3/3 or 4/4 or 5/5). If the shooter does not roll a hard point (1/1 and 6/6 are considered 'craps' and are not points) or the shooter rolls a hard point on the come out roll but does not make the same hard point before rolling a seven (or makes the point without rolling the hard point), then the player loses the wager.

U.S. Pat. No. 8,540,248, issued Sep. 24, 2013 to Golden, shows a casino craps table layout with unique wagering opportunities. There are specific wagering areas for placing a wager on at least one of two new wagering opportunities.

These new wagering opportunities are selected from the group consisting of a) a wager that the next roll of the dice will be a hard 4, 6, 8 or 10 and b) a wager that the next roll of the dice will be a pair of numbers. Another new wagering opportunity is a placed wager for any specific number (e.g., 4, 5, 6, 8, 9, and 10).

U.S. Pat. No. 7,377,513, issued May 27, 2008 to Friedman, provides a craps side wager. The player can choose whether the next roll will be even or odd. If the player chose wrong, the player loses the wager. If the player chose right, then the player can win even money on the wager, unless the roll is a craps number, in which the player can win less than even money.

U.S. Pat. No. 5,487,547, issued Jan. 30, 1996 to Hobert provides a craps gaming layout arrangement which permits the game of craps to be played in a conventional manner while simultaneously introducing a jackpot into the game.

U.S. Pat. No. 5,490,670, issued Feb. 13, 1996 to Hobert describes a gaming layout for the game of Craps having a jackpot box for receiving a wager that a set of randomly generated dice outcomes will be rolled. The set of randomly generated dice outcomes has a remote probability of occurrence and is selected from a predefined set of limited possible outcomes. A jackpot corresponds to a higher payoff than the playoffs associated with the ongoing possibilities of a conventional Craps game. The dice outcomes may be generated by a computer or by mechanical means. The dice outcomes to be matched and the corresponding tally of matches achieved are displayed for the bettors to observe.

U.S. Pat. No. 5,728,002, issued Mar. 17, 1998 to Hobert describes a craps game that incorporates a jackpot wagering area in a traditional craps game. In the jackpot wagering area, a player may make a bet that covers multiple wagers, including at least one jackpot sequence wager that a jackpot sequence of dice outcomes will be rolled. The jackpot sequence has a relatively remote possibility of occurrence and, correspondingly, a high payoff. A jackpot wagering area bet covers wagers in addition to the jackpot sequence wager. For example, the bet may also cover an additional jackpot sequence wager, a lower payoff sequence wager, or a traditional craps wager.

U.S. Pat. No. 5,829,749, issued Nov. 3, 1998 to Hobert describes a method of playing a craps game that incorporates a jackpot wagering area in a traditional craps game. The method includes receiving a bet that a jackpot sequence of dice outcomes will be rolled. The jackpot sequence has a relatively remote possibility of occurrence and, correspondingly, a high payoff. A jackpot wagering area bet may cover wagers in addition to the jackpot sequence wager. For example, the bet may also cover an additional jackpot sequence wager, a lower payoff sequence wager, or a traditional craps wager. Also, the method of playing a craps game with a jackpot sequence wager may be player on a video screen.

U.S. Pat. No. 6,761,353 issued Jul. 13, 2004 to Berman et al. describes a dice game embodied in a table or slot machine format utilizing spinning wheels or slots to generate numbers based multiple repetitions or a count of numbers prior to novel termination and payout events. The preferred embodiment differs from traditional craps in that there is no requirement of a repeated number roll for a win. In one embodiment, a number other than seven, the target number, can be rolled on two six sided dice, numbered on sides from 1-6, in a tournament style fashion over a selected calendar period to win the primary wager. These games include counting the rolls on different players and comparing those rolls and making an award to the player making {a) the most rolls, (b) the most points, (c) the fewest points or rolls or (d) enhanced pay outs for higher targets during a limited {e.g. 4) number of dice rolls. A video layout is disclosed which replaces traditional displays with multiple dice rolls in a novel fashion otherwise consistent with the disclosure herein. A method of generating random numbers using a chute is disclosed as well as a method of determining random results based on mathematical utilization of multiple dice rolls.

U.S. Pat. No. 5,513,851 issued May 7, 1996 to Harris describes a gaming apparatus and method which relate to a dice table game having at least two levels of wagering in cooperation with an optional jackpot wager. During operation, a player places an optional jackpot wager and a first level wager upon one of the possible dice combinations. If the player loses at the first level both wagers are taken by the house. If the player wins at the first level, the player's jackpot wager remains and the player is paid for the first level wager based upon the odds associated with the selected dice combination. When the player wins at the first level, the player is required to place a wager upon a second level by selecting one of the possible combinations of dice offered at the second level. If the player loses at the second level, the second level wager and the jackpot wager are taken by the house. When the player wins at the second level, a payout is effected based upon the odds associated with the dice combination selected by the player and the jackpot wager is held. After a win at the second level the player is again required to place a wager at a third level. The third level corresponds to a single dice combination, such as "2". If the third level dice combination is rolled, the player is paid according to a third level payout. In addition, if the player made the appropriate jackpot wager prior to wagering at the first level, the player is also paid from a jackpot.

U.S. Pat. No. 5,934,676, issued Aug. 10, 1999 to Rubin describes an electronically and physically improved craps game table designed to provoke and stimulate the interest of novice, occasional, and veteran craps game player. The craps game table comprises: a dice rolling area; event registration means for registering a combination rolled: an electronic recent event display; and, a computer programmed to display historical and recent events. A preferred aspect of this invention provides for a craps game table as above wherein the computer is additionally programmed to summarize the most recent events, and wherein the computer is programmed to display the last nine events. The craps game table may additionally be marked to allow game players to wager on events sequentially occurring in two and more moves; and the computer may be programmed to display payoffs for those sequentially occurring events. The most preferred embodiment additionally provides for multiple individual bet placement layouts around the periphery of the table. The electronically improved craps game table provides for the possibility of previously unavailable bet combinations; sequential bet possibilities which will attract game players with astronomical, ever changing and electronically posted payoffs; payoffs which will be exceptionally lucrative to the casinos.

U.S. Pat. No. 6,655,689, issued Dec. 2, 2003, U.S. Pat. No. 7,100,919, issued Sep. 5, 2006, and U.S. Pat. No. 7,686,305, issued Mar. 30, 2010 all to Stasi describe a proposition bet for Craps referred to as a FIRE BET™. The method includes predetermining a schedule of a pay-out table, players placing FIRE BET™ wagers at respective player betting areas prior to a shooter's initial come out; accumulating points responsive to outcomes of the shooter's dice throws, wherein points are made when a number 4, 5, 6, 8, 9 or 10 is twice rolled before sevening out, and wherein repeating of any made number is ignored, and making a pay-out based upon the points accumulated and the schedule.

U.S. Pat. No. 6,805,352, issued Oct. 19, 2004 to Hunter describe a progressive jackpot is awarded in a craps game. Three dice are used in the come-out roll. The progressive jackpot is funded with an ante from each player who places a bet in the craps game. A chance to win the progressive jackpot is initiated whenever a first predetermined outcome occurs in the come-out roll. The progressive jackpot is awarded to the current players if a roll subsequent to the come-out roll having a first predetermined outcome has a second predetermined outcome. The outcome of at least two of the dice in the come-out roll are used to determine the outcome of the craps game only if the come-out roll does not achieve the first predetermined outcome. The winning event for the progressive jackpot was (a) funding the progressive jackpot with an ante from each player who places a bet in the craps game; b) initiating a chance for the current players to win the progressive jackpot whenever a first predetermined outcome occurs in the come-out roll; (c) awarding the progressive jackpot to the current players if a roll subsequent to the come-out roll having a first predetermined outcome has a second predetermined outcome; and (d) using the outcome of at least two of the dice of the come-out roll to determine the outcome of the craps game only if the come out roll does not achieve the first predetermined outcome.

U.S. Patent Application No. 20130225254, published Aug. 29, 2013 by Pececnik et al., puts forth a system and process for effecting a side bet game during play of an underlying game of craps. The side bet wagers are paid at odds for achievement of consecutive random outcome events after establishment of the Point, with the random outcome events being selected from the non-repeating group consisting of remaining available value numbers of 4, 5, 6, 8, 9, and 10. Making the original Point may provide an even higher level of resolution of the wager.

U.S. Patent Application No. 2008/0128990, published Jun. 5, 2008 by Lowery et al., concerns a casino craps game which includes a jackpot betting area and payout from the jackpot bets based upon pre-established consecutive outcome. In the preferred embodiment, before a point is established and before a 2, 3, or 12 is rolled, players have the opportunity to bet that the shooter will roll a pre-established number of consecutive rolls, each of which is a seven or eleven. Payoff is made upon such occurrences.

U.S. Patent Application No. 2008/0122176, published May 29, 2008 by Dickerson et al., discloses a new bet for the game of Craps referred to as "spot bets" wherein a player places a bet that one or both of the dice will show up with a certain number of spots on its upward face. The spot bet combines turn bets and hopper bets, except in this case one individual bet takes the place of 6 separate bets. The player ca bet on the 2 spot, for example and this takes place of individual turning bets on the 1-2, the 3-2, the 4-2, the 5-2 and the 6-2 and a hopper bet on the 2-2. Furthermore, the player can make analogous spot bets on the 1-spot, the 3-spot, the 4-spot, the 5 spot, and/or the 6-spot. Another option is the small spot bet wherein the player is betting on 5 separate numbers, none of which adds to 7. The player can bet on the 2 "small spot", for example, and this takes place of individual turning bets on the 1-2, the 3-2, the 4-2, and the 6-2 and a hopper bet on the 2-2.

U.S. Patent Application No. 2008/0054565, published Mar. 6, 2008 by O'Connor et al., claims a craps game apparatus including a craps game layout and dice for generating a plurality of dice role outcomes, wherein each dice role outcome yields an integer number from 2 through 12. The craps game layout has a pass line wagering area for receiving a bet on a pass outcome. The pass outcome occurs when a dice roll outcome yields an established point number before an outcome of 7. A bonus betting location is provided for receiving a bet on a bonus outcome based on a sequence of the dice roll outcomes. The bonus outcome occurs when the sequence of dice roll outcomes includes a predetermined number of consecutive pass outcomes before a bonus bet termination event, such as a seven out or a crap out.

U.S. Patent Application No. 2008/0061505, published Mar. 13, 2008 by Snow, describes a side bet is added to the play of a game of Craps. A. player places a side bet wager on an occurrence of an event comprising at least three consecutive Pass events. The Points may be selected from at least the traditional Points selected from the group consisting of 4, 5, 6, 8. 9 and 10. A player or electronic simulation provides a roll or throw of the dice and the game of Craps is played in its conventional manner. The casino or gaming apparatus identifies consecutive Passes made, independent of the Pass event.

U.S. Patent Application No. 2004/0173966, published Sep. 9, 2004 by Stasi discloses a craps game that uses a plurality of point markers, the plurality of point markers comprising; a first made point marker indicative of a first made point accumulation; a second made point marker indicative of a second made point accumulation; a third made point marker indicative of a third made point accumulation; a fourth made point marker indicative of a fourth made point accumulation; a fifth made point marker indicative of a fifth made point accumulation: and a sixth made point marker indicative of a sixth made point accumulation.

US Patent Application No. 2006/0097452, published May 11, 2006 by Ryan et al. describes a method of playing a conventional game of Craps with an improvement including the step of placing a bet on the Craps game being played where the bet is independent of the game being played and of other bets being made during the game. The step of placing a bet further includes betting that the next throw of the dice in the Craps game will result in a 6, 7, or 8 being thrown.

US Patent Application No. 20060043678 published Mar. 2, 2006 by Golden describes a casino craps table layout and game which is provided with unique wagering opportunities. There are specific wagering areas for placing a wager on at least one of two new wagering opportunities. These new wagering opportunities are selected from the group consisting of a) a wager that the next roll of the dice will be a hard 4, 6, 8 or 10 and b) a wager that the next roll of the dice will be a pair of numbers. Another new wagering opportunity is a placed wager for any specific number (e.g., 4, 5, 6, 8, 9, and 10).

What is needed is an optional side bet in a casino craps game for a shooter rolling all of the dice roll combinations for point numbers requiring all of the dice roll combinations of at least two point numbers and more up to all six point numbers having all of the dice roll combinations for the point numbers rolled in any order before a shooter rolls a 7, thereby providing much higher payout odds than other casino craps bets up to 200 to 1 or 300 to 1 payout odds for the optional side bet which may remain on the table through a number of rounds and shooters until a shooter rolls a 7.

SUMMARY OF THE INVENTION

An object of the present invention is to provide an optional side bet in a casino craps game for a shooter rolling all of the dice roll combinations for point numbers requiring all of the dice roll combinations of at least two point numbers and more up to all six point numbers having all of the dice roll combinations for the point numbers rolled in any order before a shooter rolls a 7, thereby providing much higher payout odds than other casino craps bets up to 200 to 1 or 300 to 1 payout odds for the optional side bet which may remain on the table through a number of rounds and a number of shooters until a shooter rolls a 7.

In brief, an optional side bet for casino craps offers the opportunity to the crap players to place an optional bet that can only be made before the Come out roll. The optional side bet of a player shall win if all of the dice roll combinations of at least two different point numbers (4, 5, 6, 8, 9, or 10) are rolled b)' a dice shooter before a 7 is rolled, and the optional side bet shall lose if fewer than two different all dice roll combinations of different point numbers are rolled before a 7 is rolled. The optional side bet shall have no bearing on any other bets made by a player at the game of craps.

Prior to the Come out roll a player may make an optional side bet in accordance to posted minimum and maximum bets permitted by a casino. The bet shall be made by a casino table operator placing gaming chips on the appropriate area of the optional side bet layout corresponding to a position of the player around the casino craps table.

The optional side bet, once made, shall not be reduced or increased at any time, and shall not be removed prior to such wager winning or the shooter throwing any 7.

Winning side bets are paid out if all dice roll combinations of at least two point numbers in any order have been rolled by the shooter before a dice roll of 7, all dice roll combinations of the point numbers comprising:

a) for 4: both: a dice roll of 1 plus 3 and a dice roll of 2 plus 2
b) for 5: both: a dice roll of 1 plus 4 and a dice roll of 2 plus 3
c) for 6: all three: a dice roll of 1 plus 5, a dice roll of 2 plus 4, and a dice roll of 3 plus 3
d) for 8: all three: a dice roll of 2 plus 6, a dice roll of 3 plus 5, and a dice roll of 4 plus 4
e) for 9: both: a dice roll of 3 plus 6 and a dice roll of 4 plus 5
f) for 10: both: a dice roll of 4 plus 6 and a dice roll of 5 plus 5.

Winning side bets are paid out according to a selected one of the side bet payout tables shown on the optional side bet layout:

| | Table 1 | Table 2 | Table 3 |
|---|---|---|---|
| Any 2 number all dice roll combinations | 4-1 | 5-1 | 5-1 |
| Any 3 number all dice roll combinations | 10-1 | 10-1 | 10-1 |
| Any 4 number all dice roll combinations | 20-1 | 20-1 | 20-1 |
| Any 5 number all dice roll combinations | 50-1 | 50-1 | 50-1 |
| All 6 number all dice roll combinations | 200-1 | 200-1 | 300-1 |

For example, if the shooter rolls the two ways to make a 4, both ways to make a 5, and both ways to make a 9, then rolls a 7, the wager is paid out for any 3 number all dice roll combinations at 10 to 1 odds.

The all dice roll point number combinations are not required to be made in any specific order or combination.

An advantage of the present invention is that it provides side betting in a casino craps game to increase the opportunity of winning and just to have another opportunity to gamble in the same craps game, and provides the casino with a higher intake of lost bets for the same craps game.

Another advantage of the present invention is that it preserves the integrity of the casino craps game being played to maintain the original unadulterated use of dice and play so that the original casino craps game is not altered by the added optional side bet.

A further advantage of the present invention is that it provides a side bet for casino craps with much higher payout odds than other casino craps bets with up to 200 to 1 or 300 to 1 payout odds.

One more advantage of the present invention is that it provides an optional craps side bet which may remain on the table through a number of rounds and a number of shooters until a shooter rolls a 7.

And additional advantage is that the additional side bets can be placed without interference to the regular play of the game.

DESCRIPTION OF THE DRAWINGS

These and other details of the present invention will be described in connection with the accompanying drawings, which are furnished only by way of illustration and not in limitation of the invention, and in which drawings.

DETAILED DESCRIPTION OF THE INVENTION

Figure 1:
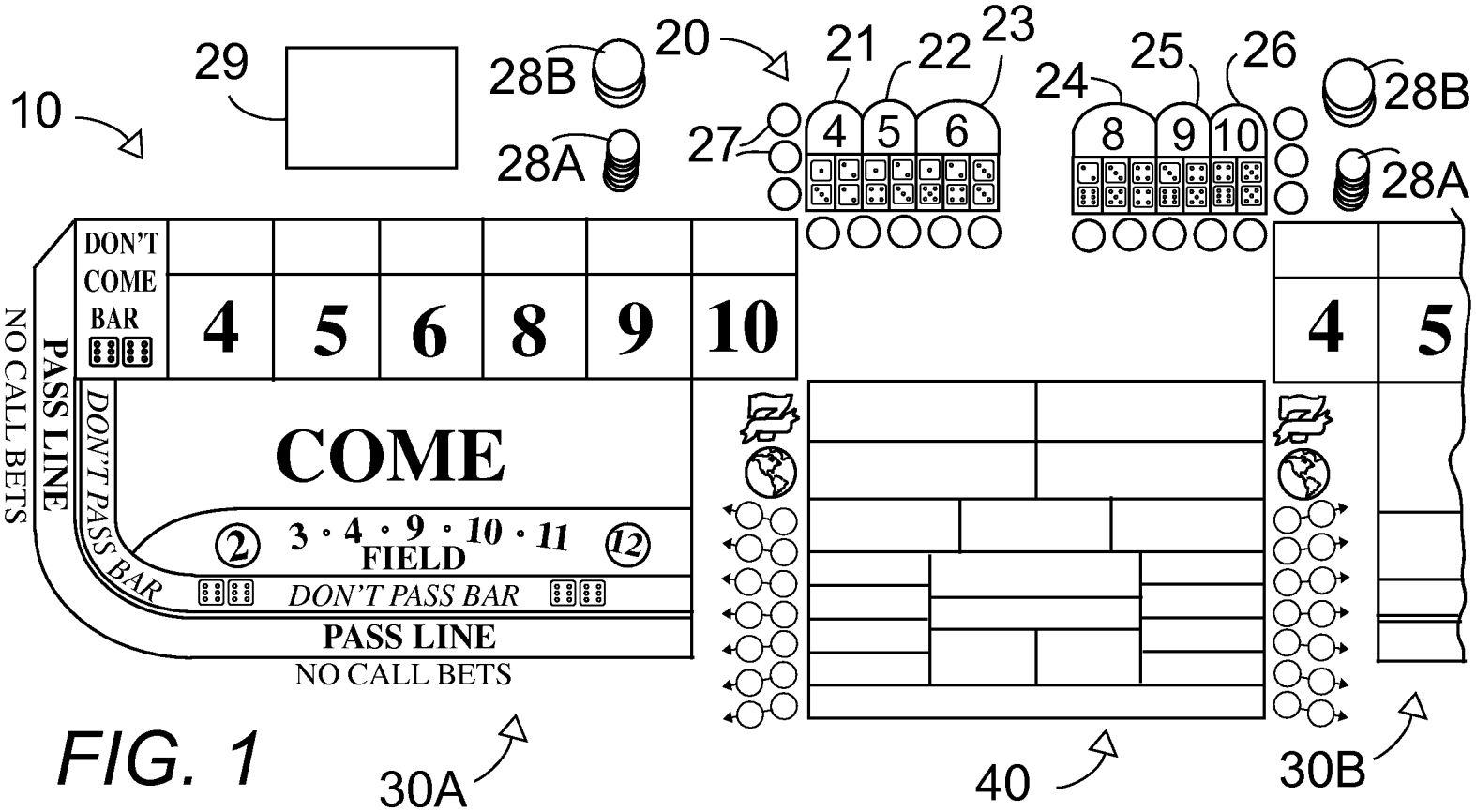
FIG. 1 is a plan view of a portion of a casino craps table of the present invention showing one end of the duplicate two-end casino craps betting layouts, the center casino craps table bets layout, and the added optional side bet layout of the present invention.

In FIGS. 1-6, a casino craps table layout 10 comprises the standard casino craps layout with an added optional side bet layout 20, showing an overview of the left end casino betting layout 30A, a partial view of the mirror-image right end casino betting layout 30B, a center casino betting layout 40, a payout table 29 for the added optional side bet, side bet chip areas 27 to place chips for the added optional side bet, small markers 28A to place on top of each point number dice combination in the side bet layout 20 that is rolled, and a larger marker 28B to place on top of each point number in the side bet layout 20 when all of the dice combinations for that point number have been rolled.

Figures 2, 3:
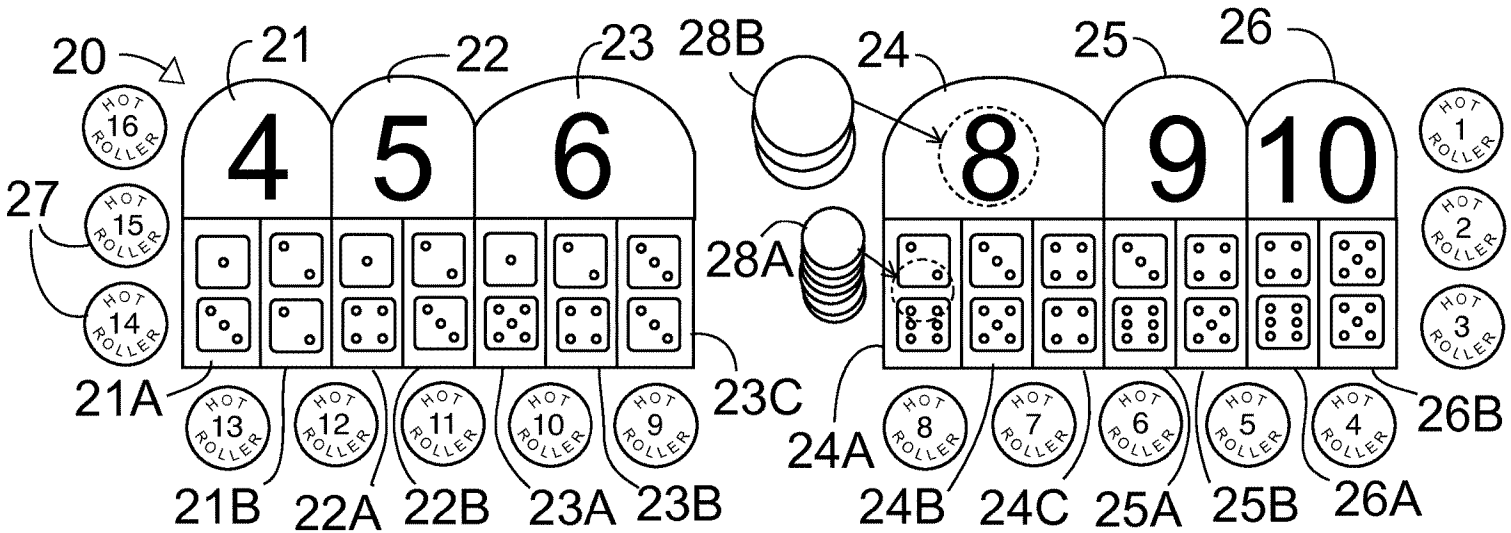
FIG. 2 is an exploded plan view of the added optional side bet layout of the present invention on the casino craps table of FIG. 1.
FIG. 3 is an exploded plan view of the payout table for the added optional side bet showing three different sets of payout odds, one of which would appear on the casino craps table of FIG. 1.
Figure 4:
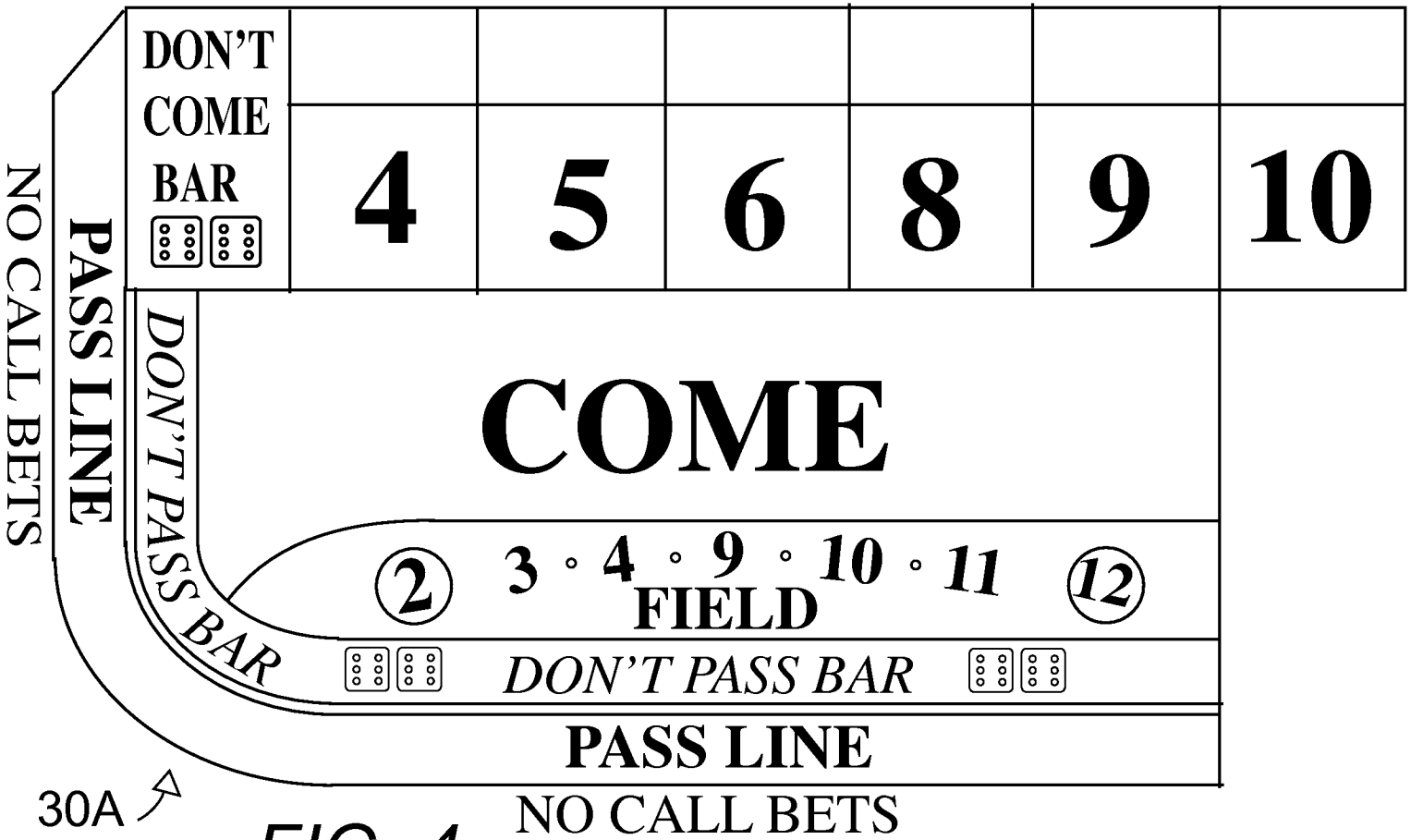
FIG. 4 is an exploded plan view of the left end betting layout on the casino craps table of FIG. 1.
Figure 5:
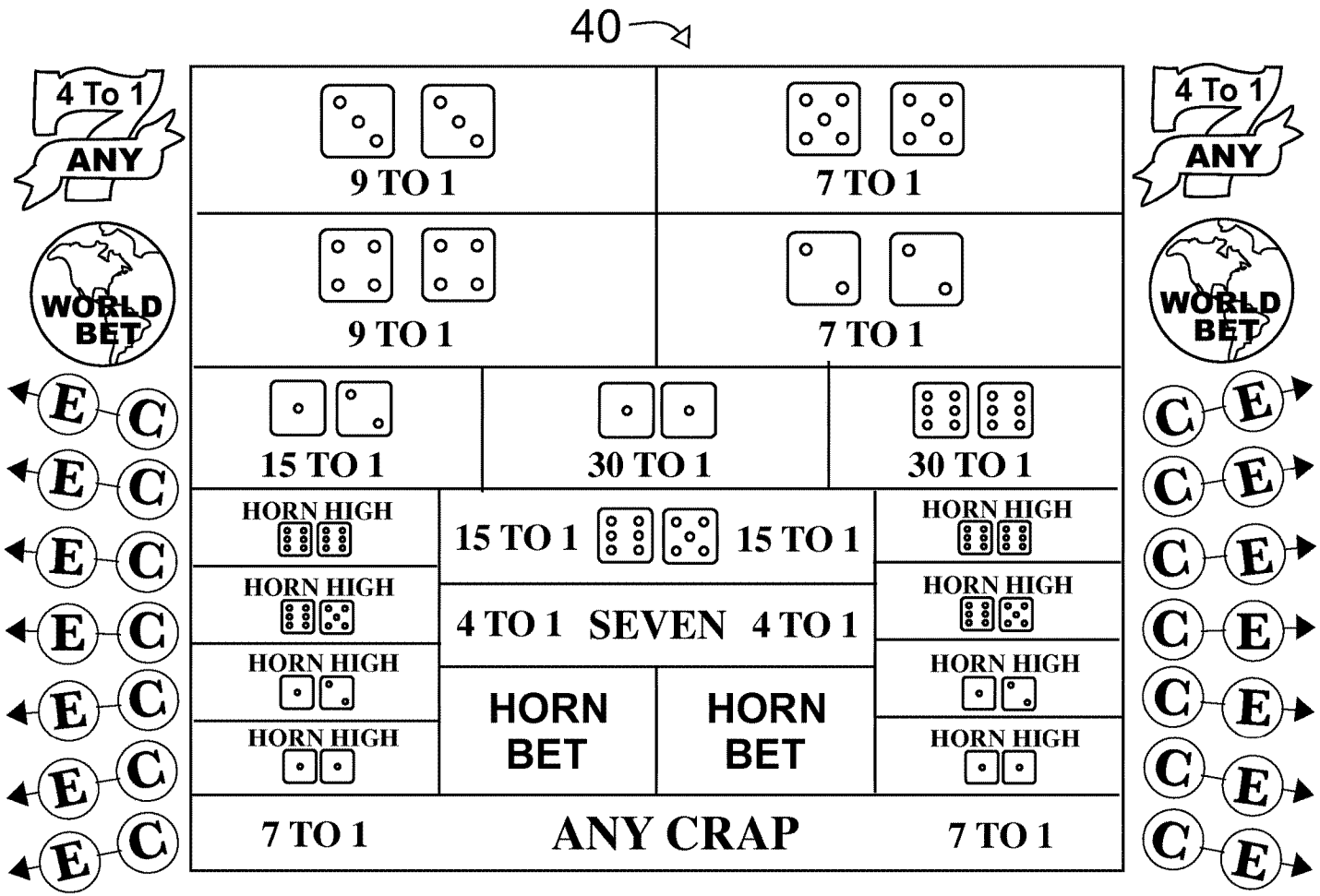
FIG. 5 is an exploded plan view of the center betting layout on the casino craps table of FIG. 1.

In FIGS. 1-6, the present invention comprises a method of playing a casino craps game, including an optional side bet on all dice combinations for point numbers, using a standard set of dice and conventional casino craps game play on a standard casino craps table layout 10. An additional side betting layout 20, and side bet payout table 29 showing all dice roll combinations of point numbers, and side bet chip areas 27 are shown in FIGS. 1-3. The optional side bet has no effect on standard casino craps playing and betting, the method comprising the following steps:

a) A separate additional side betting layout 20 and side bet payout table 29 and chip area 27 for placing bets are added to a standard casino craps betting and playing layout 10 on a casino craps table. The separate additional side betting layout 20 comprises boxes with dice images (21 A-B, 22A-B, 23A-C, 24A-C, 25A-B, 26A-26B) of all dice roll combination for each point number 4, 5, 6, 8, 9, and 10 in boxes 21, 22, 23, 24*o* 25, and 27 respectively, and the a small marker 28A means for marking each dice roll combination (21A-B, 22A-B, 23A-C, 24A-C, 25A-B, 26A-26B) made and a larger marker 28B for marking each point number box 21, 22, 23, 24*o* 25, and 27 in the side bet payout table 29 on the side bet layout 20 when all dice roll combinations have been rolled for that point number. Slide bet placing locations 27 are positioned around the side bet layout 20 corresponding to player locations positioned around the casino craps table. The side bet payout table 29, in FIGS. 1 and 3, comprises payout odds for winning the separate additional side bet and is placed intermittently between the betting areas of the outer table where players can have their chips placed to indicate betting on the additional side bet.

b) Standard casino craps bets are placed on the casino craps betting layout in appropriate betting locations designated on the casino craps betting layout 10.

c) Optional side bets are placed on the side bet chip area 27 around the outside of the table, with the stick man of the table moving the bets to the appropriate betting location 27 in the side bet layout 20. The optional side bets are placed prior to a come out roll of the standard casino craps game play, the optional side bet remaining in place through any number of rounds and any numbers of dice shooters until a dice roll of 7 in rolled by a shooter.

d) A pair of dice is provided to a shooter, and a player designated to roll the dice.

e) A standard casino craps game is played according to conventional casino craps rules having a sequence of rounds of play, with a single shooter rolling a pair of dice during each round to produce numbers which each comprise a sum of the number of dots on each of the pair of dice. Players place conventional casino craps bets in the designated betting areas of each end betting area 30A and 30B and in the middle betting area 40 related to the dice rolls during the progress of each round of play, and dealers pay out casino craps winning bets and take in casino craps losing bets according to standard casino craps play.

f) The stick man places the small dice roll marker 28A to mark each dice roll combination of a point number on the dice roll indication area 21A-B, 22A-B, 23A-C, 24A-C, 25A-B, 26A-B of the side bet layout 20 and then, if necessary, indicates all possible combinations of a number have been rolled by placing the large dice roll marker 28B on the side bet number 21-26 of which the combination has been completed, until a 7 is rolled. Then the winning side bets are paid out or alternately the losing side bets are taken in and dice roll markers 28A and 28B are removed.

g) Upon a dice roll of 7 thrown by a shooter, winning side bets are paid out if at least two different all dice roll combinations of 4, 5, 6, 8, 9, or 10 are rolled by the shooter before the dice roll of 7 is rolled. Payout is according to the odds posted on the side bet payout table 29, wherein the side bet will remain up to bet again, with each side bet winning player having an option to increase or decrease the side bet after payout. Alternately losing side bets will be taken in if fewer than two different all-dice roll combinations of 4, 5, 6, 8, 9, or 10 have been rolled by the shooter before the dice roll of 7 is rolled.

h) After the side bet payouts and takes, any player can place a new optional side bet in accordance with the procedure of the previous side bet steps.

The optional side bet of step c, once made, shall not be reduced or increased or removed at any time prior to a shooter rolling any dice roll of 7, and must be placed in accordance with posted minimum and maximum bets permitted by a casino licensee.

Step f comprises paying out winning side bets if all dice roll combinations of at least two point numbers in any order have been rolled by the shooter before a dice roll of 7. All dice roll combinations of the point numbers comprise:

a) for 4: both: a dice roll of 1 plus 3 and a dice roll of 2 plus 2
b) for 5: both: a dice roll of 1 plus 4 and a dice roll of 2 plus 3
c) for 6: all three: a dice roll of 1 plus 5, a dice roll of 2 plus 4, and a dice roll of 3 plus 3
d) for 8: all three: a dice roll of 2 plus 6, a dice roll of 3 plus 5, and a dice roll of 4 plus 4
e) for 9: both: a dice roll of 3 plus 6 and a dice roll of 4 plus 5
f) for 10: both: a dice roll of 4 plus 6 and a dice roll of 5 plus 5.

Paying out winning side bets, if at least two different all dice roll combinations of 4, 5, 6, 8, 9, or 10 are rolled in any order by a shooter before the dice roll of 7 is rolled, is according to a selected one of the side bet payout tables 29 shown on the optional side bet layout and/or around the outside of the craps table 10:

| | Table 1 | Table 2 | Table 3 |
|---|---|---|---|
| Any 2 number all dice roll combinations | 4-1 | 5-1 | 5-1 |
| Any 3 number all dice roll combinations | 10-1 | 10-1 | 10-1 |
| Any 4 number all dice roll combinations | 20-1 | 20-1 | 20-1 |
| Any 5 number all dice roll combinations | 50-1 | 50-1 | 50-1 |
| All 6 number all dice roll combinations | 200-1 | 200-1 | 300-1 |

Upon a shooter rolling a come out roll of 2, 3, 11, or 12 the side bet is a push which will remain in the betting circle until a next roll, with the player able to remove, or reduce, or increase their side bet before the next roll.

A casino craps table 10 is provided for carrying out the steps of the method of playing, with each player being positioned around the casino craps table 10 with other players and casino personnel. Each player carries out the steps of the method of playing the casino craps game and added optional side bet by physically placing bets themselves or with the casino personnel on designated casino craps bet locations and on the added optional side bet layout 20 on the casino craps table 10 with the players alternately rolling a pair of dice on the casino craps table 10.

A simulation device may also be provided for carrying out the method of playing, with each player carrying out the steps of the method of playing the casino craps game and added optional side bet by placing bets on designated casino craps bet locations 30A, 30B, 40, and on the added optional side bet layout 20 with the players alternately rolling a pair of dice by manipulating the simulation device and placing simulation bets on designated craps bets and side bets layouts on the simulation device.

A mechanical simulation device may be provided for carrying out the method of playing, each player carrying out the steps of the method of playing the casino craps game and added optional side bet by placing bets on designated casino craps bet locations 30A, 30B, 40, and placing bets in the added optional side bet layout 20 on the mechanical simulation device and the players alternately rolling a pair of dice on the layout on the mechanical simulation device. This may be a roll-out or fold-up simulation of the casino craps table with the additional all dice roll combinations for each point number side bet areas provided on a simulated layout replicating the casino craps table layout 10, as shown in FIG. 1, on a folded or rolled up sheet, which may be in a game box to be used in at home or at a charitable function.

Figure 6:
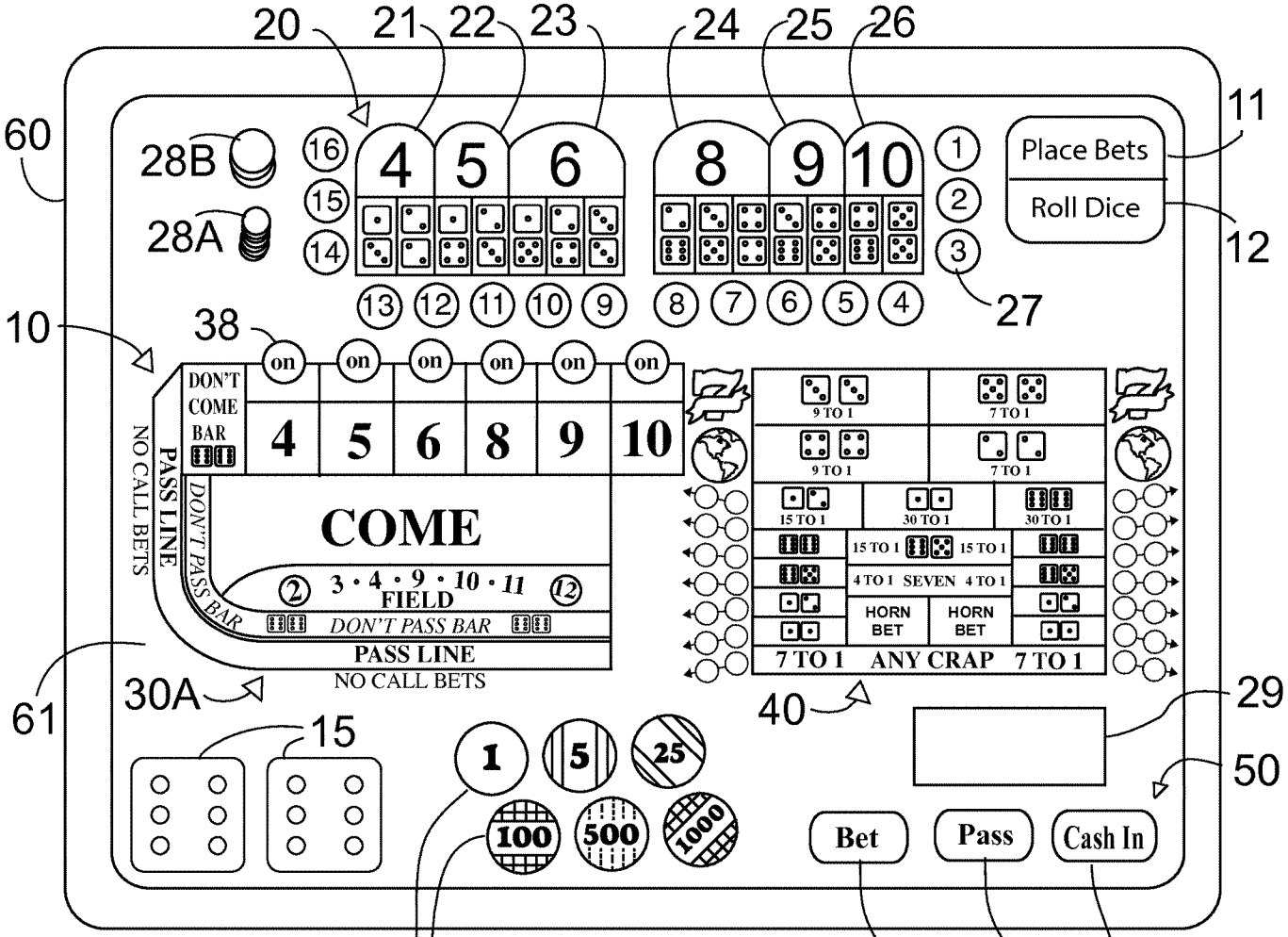
FIG. 6. is an elevational view of an electronic simulation of the casino craps betting layout with the added optional side bet layout of the present invention shown on a screen of an electronic simulation device.

In FIG. 6, an elevational view of an electronic simulation of the casino craps betting layout 10 with the added optional side bet layout 20 is shown on a screen 61 of an electronic simulation device 60. The electronic simulation device, such as a computer, hand-held electronic device, mobile phone device or any other electronic simulation computing, gaming or communicating device having a display screen, may be provided for carrying out the method of playing the casino craps game and added optional side bet of the present invention. The electronic device is programmed to play the casino craps game with an optional side bet using the method of the present invention, the device programmed to manipulate virtual elements on the screen such as placing the chips 55 bet by the players and marking the dice roll combinations made for point numbers by moving virtual tokens 28A and 28B onto appropriate areas of the optional side bet layout 20 and such as a Place Bets and Roll Dice areas which may light up at appropriate times in the normal course of play, and rolling the virtual dice 15 to produce random dice throws shown on the virtual dice 15 on the screen 61. The player uses an input means for the particular type of electronic simulation device being used, such as touching a touch screen for mobile devices, using a mouse or keyboard for a computer device, using gaming equipment for a game monitor or TV screen, or any other input means for electronic simulation devices.

The electronic simulation device 60 comprises a screen 61 showing a virtual representation of at last a portion of the casino craps table layout 10 of FIG. 1, including craps betting layouts 30A, 30B 40, and added optional side bet layout 20, as well as a virtual representation of a pair of dice 15. Players interact with the electronic simulation device, each player carrying out the steps of the method of playing the casino craps game and optional side bet of the present invention using the electronic simulation device by inputting commands indicating virtual bets on designated virtual craps bet locations 30A, 30B, 40, and added optional virtual side bet location 20, and by inputting commands for simulating casino craps play by activating designated input areas 50 displayed on the screen 61. The electronic simulation device also comprises a program to carry out the casino personnel steps, including payouts and takes, in response to the simulated rolling of the virtual pair of dice 15.

To place bets, a player selects the amount of a bet by activating any desired combination of virtual chips 55 for a betting amount within the designated limits of the casino craps game being played. Activating each of the virtual chips 15 has a color, indicated by the color coded areas of the circles representing the virtual chips and a currency amount, such as number of dollars, shown on the virtual dice. Each of the different chip values bears a different color: white for $1, red for $5, green for $25, yellow, for $100, purple for $500, and orange for $1000. For example, to bet $250, a player would activate the $100 dollar virtual chip twice and the $25 virtual chip twice 5 and then activate the betting area on one of the betting layouts 30A, 30B, 40 or 20 for the bet to be placed. After all player bets have been placed, the player activates the Bet 51 player control input area on the screen. If a player does not wish to place any bets when no bets are required, the player activates the Pass 52 player control input area on the screen.

The automated program activates the Place Bets 11 programmed control area to indicate that players should place their bets. After all bets are placed or a pass indicated by all players the program automatically activates the Roll Dice 12 programmed control area to indicate that no more bets can be placed and the simulated dice 15 will be rolled. The betting and dice rolling follow the normal course of play for casino craps.

When a shooter is rolling to make a point number, the automated program automatically places a simulated small dice roll token 28A on each unique dice roll combination made for any of the point numbers and places a simulated large point number token 28B on a point number after all of the dice roll combinations for that point number. After a shooter rolls a 7 when trying to make a point roll, the optional side bets are paid out to players making the optional side bet if the total dice roll combinations for each point number have been rolled for at least two of the point numbers prior to the 7 roll. Otherwise the players lose the optional side bets.

The electronic simulation device may also have a connection to a remote network for carrying out the method of playing the casino craps game and added optional side bet, so that a player uses the electronic simulation device with a connection to a remote network for playing the casino craps game and added optional side bet using the method of the present invention. The connection to the remote network can either be wired or wireless.

The electronic simulation device may be a computer, a mobile device, a handheld device, a telephonic device, an entertainment device, a gaming device, a television device or any other electronic device having a display screen.

In use, a standard casino craps table layout 10 has an additional optional side betting layout 20 on which players may place a bet before the come out roll that a every combination of 2 or more of the following numbers will be rolled before a 7 is rolled: 4, 5, 6, 8, 9, or 10. Bets are placed in accordance to posted minimum and maximum bets permitted by a casino. This separate bet is played concurrent with the ongoing game of craps. A pair of dice is provided to a shooter, the player designated to roll the dice. If a 7 is rolled on the dice as the come out roll all side bets lose and are collected by the dealer. If during the come out roll a 2, 3, 11, or 12 are rolled the bet is a 'push' and may remain in the betting circle, or be removed, reduced, or increased before the next roll. If a 4, 5, 6, 8, 9, or 10 is rolled as the come out roll, the wager will remain, and cannot be removed, reduced or increased, until any 7 is rolled to end the wager round. As numbers are rolled with the dice by the shooter of the round, the dealer or stick man marks each combination that is rolled with a small side bet dice roll marker. When all combinations of one of the side bet numbers (4, 5, 6, 8, 9, or 10) have been rolled in any order, the dealer will then place a large side bet dice roll marker over the number whose combinations have been met, indicating no more combinations of this number are needed. When a 7 is rolled, the round ends. If every combination of two or more of the designated numbers have been rolled in any order (ie, there is a large marker covering two or more of the numbers on the side bet area), the bet is paid out according to the side bet payout table. If every combination of two or more of the designated numbers have not been rolled, then players betting the side bet lose and the dealer will collect the bets. Players may bet again at the start of the next round of play with the new shooter before the come out roll.

It is understood that the preceding description is given merely by way of illustration and not in limitation of the invention and that various modifications may be made thereto without departing from the spirit of the invention as claimed.

What is claimed is:

1. A method of playing a casino craps game including an optional side bet on all possible dice combinations for point numbers using a standard set of dice and conventional casino craps game play on a standard casino craps table layout having an additional side betting layout and side bet payout table for all dice roll combinations of point numbers, the optional side bet having no effect on standard casino craps playing and betting, the method comprising the following steps:

a) providing a casino craps table betting layout having an additional side betting layout, the separate additional side betting layout comprising demarked areas on the casino craps table of all possible dice roll combinations for each point number 4, 5, 6, 8, 9, and 10 and providing means for marking each dice roll combination on the side bet layout as each dice roll combination is rolled, and further comprising side bet placing locations positioned around the side bet layout corresponding to player locations positioned around the casino craps table; and providing the side bet payout table comprising payout odds for winning the separate additional side bet;

b) receiving standard casino craps bets placed on the casino craps betting layout in appropriate betting locations designated on the casino craps betting layout;

c) receiving optional side bets placed on the side bet placing locations positioned around the side bet layout corresponding to the side betting player locations positioned around the casino craps table, the optional side bets being placed prior to a come out roll of the standard casino craps game play, the optional side bet remaining in place through any number of rounds and any numbers of dice shooters until a dice roll of 7 is rolled by a shooter;

d) providing a pair of dice to a shooter;

e) playing a standard casino craps game according to conventional casino craps rules having a sequence of rounds of play having a single shooter rolling a pair of dice during each round producing numbers which each comprise a sum of the number of dots on each of the pair of dice and receiving conventional casino craps bets from players related to the dice rolls during the progress of each round of play, and paying out casino craps winning bets and taking in casino craps losing bets according to standard casino craps play;

f) placing one of the means for marking each dice roll combination of a point number on the dice roll indication of the side bet layout as each dice roll combination of a point number is rolled until a 7 is rolled;

g) upon a dice roll of 7 thrown by a shooter, paying out winning side bets when at least two different all dice roll combinations of 4, 5, 6, 8, 9, or 10 are rolled by the shooter before the dice roll of 7 is rolled according to the odds posted on the side bet payout table, wherein the all dice roll combinations of 4, 5, 6, 8, 9, or 10 each comprise rolling all possible dice roll combinations for the respective point number, wherein the side bet will remain up to bet again, each side bet winning player having an option to increase or decrease the side bet after payout, and alternately taking in losing side bets if fewer than two different all dice roll combinations of 4, 5, 6, 8, 9, or 10 have been rolled by the shooter before the dice roll of 7 is rolled;

h) after the side bet payouts and takes, receiving a new optional side bet from one or more players in accordance with the procedure of the previous side bet steps;

thereby providing a method of playing a casino craps game including the optional side bet on all dice roll combinations for point numbers using a standard set of dice and conventional casino craps game play on a standard casino craps table layout having the additional side betting layout and the side bet payout table for all dice roll combinations for point numbers, the optional side bet having no effect on the standard casino craps playing and betting.

2. The method of claim 1 wherein the optional side bet, once made, is not reduced or increased or removed at any time prior to a shooter rolling any dice roll of 7.

3. The method of claim 1 wherein the step of receiving optional side bets comprises receiving a bet in accordance to posted minimum and maximum bets permitted by a casino licensee.

4. The method of claim 1 comprising paying out winning side bets if the all possible dice roll combinations of at least two point numbers in any order have been rolled by the shooter before a dice roll of 7, the all possible dice roll combinations of the point numbers comprising:

a) for 4: both: a dice roll of 1 and 3 and a dice roll of 2 and 2 ;

b) for 5: both: a dice roll of 1 and 4 and a dice roll of 2 and 3 ;

c) for 6: all three: a dice roll of 1 and 5 , a dice roll of 2 and 4 , and a dice roll of 3and 3;

d) for 8: all three: a dice roll of 2 and 6 , a dice roll of 3 and 5 , and a dice roll of 4and 4;

e) for 9: both: a dice roll of 3 and 6 and a dice roll of 4 and 5 ; and f) for 10: both: a dice roll of 4 and 6 and a dice roll of 5 and 5 .

5. The method of claim 1 comprising paying out winning side bets if at least two different all possible (dice roll combinations of 4, 5, 6, 8, 9, or 10 are rolled in any order by a shooter before the dice roll of 7 is rolled comprising paying out according to a selected one of the side bet payout tables shown on the optional side bet layout:

| | Table 1 | Table 2 | Table 3 |
|---|---|---|---|
| Any 2 number all dice roll combinations | 4-1 | 5-1 | 5-1 |
| Any 3 number all dice roll combinations | 10-1 | 10-1 | 10-1 |
| Any 4 number all dice roll combinations | 20-1 | 20-1 | 20-1 |
| Any 5 number all dice roll combinations | 50-1 | 50-1 | 50-1 |
| All 6 number all dice roll combinations | 200-1 | 200-1 | 300-1. |

6. The method of claim 1, further comprising upon a shooter rolling a come out roll of 2, 3, 11, or 12 pushing the side bet which will remain in the betting circle until a next roll, with the side bet alternately being removed, or being reduced, or being increased before the next roll.

7. The method of claim 1, wherein the step of placing one of the means for marking comprises placing a marker bearing the point number thrown by the shooter on the corresponding dice roll combination for the point number on the side bet layout.

8. The method of claim 1 further comprising the step of providing a casino craps table for carrying out the steps of the method of playing, each player being positioned around the casino craps table with other players and casino personnel, each player carrying out the steps of the method of playing the casino craps game and added optional side bet by physically placing bets by the players or the casino personnel on designated casino craps bet locations and placing bets in the added optional side bet layout on the casino craps table and the players alternately rolling a pair of dice on the casino craps table.

9. The method of claim 1 further comprising the step of providing a simulation device for carrying out the method playing, each player carrying out the steps of the method of playing the casino craps game and added optional side bet by placing bets on designated casino craps bet locations and placing bets in the added optional side bet layout and the players alternately rolling a pair of dice by manipulating the simulation device and placing simulation bets on designated craps bets and side bets layouts on the simulation device.

10. The method of claim 9 comprising the step of providing a mechanical simulation device for carrying out the method of playing, each player carrying out the steps of the method of playing the casino craps game and added optional side bet by placing bets on designated casino craps bet locations and placing bets in the added optional side bet layout on the mechanical simulation device and the players alternately rolling a pair of dice on the layout on the mechanical simulation device.

11. The method of claim 9 comprising the step of providing an electronic simulation device for carrying out the method of playing the casino craps game and added optional side bet, the electronic simulation device comprising a screen showing virtual representation of the casino craps layout and added optional side bet layout and a virtual representation of a pair of dice, and further comprising means for a player to interact with the electronic simulation device, each player carrying out the steps of the method of playing the casino craps game and optional side bet using the electronic simulation device by inputting commands indicating virtual bets on designated virtual craps bet locations and added optional virtual side bet locations, and by inputting commands for simulating rolling of the virtual pair of dice, and further comprising an electronic simulation device program carrying out the casino personnel steps, including payouts and takes, in response to the simulated rolling of the virtual pair of dice.

12. The method of claim 11 wherein any step comprising placing bets comprises an automatically programmed electronic simulation device control indicating place bets on the screen, selecting an amount of a bet by activating any desired combination of different value virtual chips for a betting amount within the designated limits of the casino craps game being played by activating each of the virtual chips necessary a number of times necessary to total the betting amount and subsequently activating a desired betting area on one of the betting layouts for the betting amount to be placed automatically by the programmed electronic simulation device and after all bets by a player have been placed, activating a bet player control input area on the screen, and alternately for a player not wishing to place any bets when no bets are required, activating a pass player control input area on the screen, until all bets have been placed by all players and the programmed electronic simulation device activating a roll dice electronic simulation device control area on the screen and automatically ceasing bets and rolling the simulated dice on the screen continuing play of the casino craps game.

13. The method of claim 11 comprising the step of providing a handheld electronic simulation device for carrying out the method of playing the casino craps game and added optional side bet, the electronic simulation device comprising a screen showing a virtual representation of the casino craps layout and added optional bet layout and a virtual representation of the pair of dice, and further comprising means for a player to interact with the handheld electronic simulation device, each player carrying out the steps of the method of playing the casino craps game and optional side bet using the handheld electronic simulation device by inputting commands indicating virtual bets on designated virtual craps bet locations and added optional virtual side bet locations, and automatically simulating rolling the virtual pair of dice, and further comprising a handheld electronic simulation device program carrying out the casino personnel steps, including payouts and takes, in response to the simulated rolling of the virtual pair of dice.

14. The method of claim 11 comprising the step of providing an electronic simulation device having a connection to a remote network tor carrying out the method of playing the casino craps game and added optional side bet, the electronic simulation device comprising a screen showing a virtual representation of the casino craps layout and added optional side bet layout and a virtual representation of a pair of dice, wherein a player uses an the electronic simulation device having a connection to a remote network for playing the casino craps game and the added optional side bet using the method of the present invention.

15. The method of claim 14 comprising the step of providing an electronic simulation device having a wired connection to a remote network for carrying out the method of playing the casino craps game and added optional side bet, the electronic simulation device comprising a screen showing a virtual representation of the casino craps layout and the added optional side bet layout and a virtual representation of a pair of dice, wherein a player uses an the electronic simulation device having a wired connection to a remote network for playing the casino craps game and added optional side bet using the method of the present invention.

16. The method of claim 14 comprising the step of providing an electronic simulation device having a wireless connection to a remote network for carrying out the method of playing the casino craps game and added optional side bet, the electronic simulation device comprising a screen showing a virtual representation of the casino craps layout and the added optional side bet layout and a virtual representation of a pair of dice, wherein a player uses an the electronic simulation device having a wireless connection to a remote network for playing the casino craps game and added optional side bet using the method of the present invention.

17. The method of claim 14 comprising the step of providing a communication electronic simulation device having a connection to a remote network for carrying out the method of playing the casino craps game and added optional side bet, the communication electronic simulation device comprising a screen showing a virtual representation of the casino craps layout and the added optional side bet layout and a virtual representation of a pair of dice, wherein a player uses the communication electronic simulation device having a connection to a remote network for playing the casino craps game and added optional side bet using the method of the present invention.

18. The method of claim 14 wherein a player uses an electronic simulation device having a connection to a remote network for carrying out the method of playing the casino craps game and the added optional side bet, the electronic simulation device comprising a screen showing a virtual representation of the casino craps layout and added optional side bet layout and a virtual representation of a pair of dice, and the electronic simulation device comprises a device taken from the list of electronic simulation devices comprising a computer, a mobile device, a handheld device, a telephonic device, an entertainment device, a gaming device, and a television device.

19. A method of playing a casino craps game including an optional side bet on all possible dice combinations for point numbers 4, 5, 6, 8, 9 and 10 using a standard set of dice on a standard casino craps table layout modified to include an additional side betting layout and side bet payout table for the optional side bet, the method comprising the following steps:

a) providing the standard casino craps table modified to include: (1) the additional side betting layout and the side bet payout table for the optional side bet, the separate additional side betting layout comprising demarked areas on the casino craps table of all possible dice roll combinations for each of the point numbers 4, 5, 6, 8, 9, and 10, the side bet payout table comprising payout odds for winning the separate additional side bet; (2) means for marking each possible dice roll combination of the numbers 4, 5, 6, 8, 9 and 10 on the side bet layout as each dice roll combination is rolled; and (3) side bet placing locations positioned around the side bet layout corresponding to player locations positioned around the casino craps table;

b) receiving standard casino craps bets placed on the casino craps betting layout in appropriate betting locations designated on the casino craps betting layout;

c) receiving optional side bets placed on the side bet placing locations positioned around the side bet layout corresponding to the side betting player locations positioned around the casino craps table, the optional side bets being placed prior to a come out roll of the standard casino craps game play;

d) playing a standard casino craps game according to conventional casino craps rules, and paying out casino craps winning bets and taking in casino craps losing bets according to standard casino craps play;

e) placing one of the means for marking each possible dice roll combination of a point number 4, 5, 6, 8, 9 or 10 on the side bet layout as each dice roll combination of a point number is rolled until a 7 is rolled; and f) upon a dice roll of 7 thrown by a shooter, paying out any winning side bets when at least two different ones of the all possible dice roll combinations of 4, 5, 6, 8, 9, or 10 are rolled by the shooter before the dice roll of 7 is rolled according to the odds posted on the side bet payout table.

20. An improved game table comprising:

a game table having:

an elevated playing surface;

a craps game layout comprising demarked areas on the playing surface defining craps game wagering locations;

an additional side betting layout comprising demarked areas on the playing surface for each of point numbers 4, 5, 6, 8, 9 and 10, and all possible dice roll combinations for each of the point numbers 4, 5, 6, 8, 9, and 10,; and (3) one or more first markers usable to mark each possible dice roll combination of the numbers 4, 5, 6, 8, 9 and 10 on the side bet layout as each dice roll combination is rolled;

wherein the all possible dice roll combinations for each of the point numbers are:

for point number 4, demarked areas of: a dice roll of 2 and 2, and a dice roll of 3and 1;

for point number 5, demarked areas of: a dice roll of 3 and 2, and a dice roll of 4and 1;

for point number 6, demarked areas of: a dice roll of 5 and 1, a dice roll of 4 and 2, and a dice roll of 3 and 3;

for point number 8, demarked areas of: a dice roll of 6 and 2, a dice roll of 5 and 3, and a dice roll of 4 and 4;

for point number 9 demarked areas of: a dice roll of 5 and 4, and a dice roll of 6and 3; and for point number 10, demarked areas of: a dice roll of 6 and 4, and a dice roll of 5and 5.

21. The improved game table of claim 20 further comprising one or more second markers usable to mark each of the point numbers 4, 5, 6, 8, 9 and 10 as all possible dice roll combinations thereof are rolled, wherein said one or more second markers are larger than said one or more first markers.

* * * * *